US005469589A

United States Patent [19]

Steed et al.

[11] Patent Number: 5,469,589

[45] Date of Patent: Nov. 28, 1995

[54] KNOCK DOWN FOUNDATION FOR A BED

[75] Inventors: C. Edward Steed, Alpharetta; Wesley H. Brinkman, Dunwoody, both of Ga.

[73] Assignee: Simmons Company, Atlanta, Ga.

[21] Appl. No.: 399,167

[22] Filed: Mar. 2, 1995

[51] Int. Cl.[6] ..... A47D 19/02

[52] U.S. Cl. ..... 5/400; 5/201; 5/207

[58] Field of Search ..... 5/400, 186.1, 200.1, 5/201, 203, 207

[56] References Cited

U.S. PATENT DOCUMENTS

| | | | |
|---|---|---|---|
| 3,869,738 | 3/1975 | Lawrence | 5/200.1 |
| 3,999,236 | 12/1976 | Macauley | 5/400 X |
| 4,128,907 | 12/1978 | Gelhart | 5/201 X |
| 4,155,131 | 5/1979 | Harris | 5/400 X |
| 4,888,838 | 12/1988 | Pelski | 5/207 |
| 5,144,706 | 9/1992 | Walker | 5/400 |
| 5,289,600 | 3/1994 | Schermel | 5/400 |

*Primary Examiner*—Michael F. Trettel

*Attorney, Agent, or Firm*—Jones, Day, Reavis & Pogue

[57] ABSTRACT

A bed foundation comprises a pair of parallel spaced side rails with ends connected by corner braces to the ends of parallel, spaced cross rails thereby defining a rectangular box frame. Upwardly facing edges of the cross rails and side rails lie in a common plane. A pair of generally planar top panels are positioned on the frame with their peripheral edges flush with the outer edges of the frame. The corner braces extend above the plane defined by the upwardly facing edges of the rails providing lips which cooperate with corners of the panels to retain the panels immovable on the frame. A third panel may be positioned between the pair of panels and a clip engages both an edge of the third panel and the upwardly facing edge of a cross rail to retain the third panel immovable relative to the frame.

10 Claims, 2 Drawing Sheets

KNOCK DOWN FOUNDATION FOR A BED

BACKGROUND OF THE INVENTION

1. Field of the Invention

The present invention relates generally to a knock down foundation for a bed, and it relates more particularly to a bed foundation which is readily shipped in compact form.

2. Description of the Prior Art

In conventional bed construction, a mattress is supported on a bed foundation which may be a box spring or other frame assembly. These foundations can be extremely bulky requiring special shipping arrangements to deliver them to the ultimate consumer. Knock down bed foundations of a type useable with water floatation mattresses, for example, are known. Such a foundation is disclosed in U.S. Pat. No. 4,734,946 issued to Saputo and comprises a plurality of interconnecting rail members fitted to one another by selectively separable joints. Another example of a knock down bed foundation is disclosed in U.S. Pat. No. 4,391,008 issued to Yakoaka et al. which teaches a framework having U-shaped brackets for supporting a plurality of dividers.

While bed foundations of the foregoing type offer advantages of being capable of knocked down packaging and shipment, it is desirable to provide a bed foundation which is not only compact to ship but is easily assembled by the consumer at its ultimate location. It is further desirable to provide a bed foundation which is highly sturdy when assembled. Still further, it is desirable to provide a bed foundation which offers the additional advantage of having an aesthetically pleasing appearance. Further, it is desirable to provide a bed foundation which can be manufactured at an economical cost.

SUMMARY OF THE INVENTION

The present invention improves over the prior art by providing a bed foundation comprising a pair of parallel, spaced side rails each having opposed ends and a pair of parallel, spaced cross rails each having opposed ends. A corner brace connects each end of a side rail at right angles to an end of a cross rail, thereby defining a box frame with edges of the side rails and cross rails facing upwardly defining a plane. At least two generally planar top panels are dimensioned and configured to be supported on the upwardly facing edges of the side rails and cross rails. The corner braces extend above the plane defined by the edges of the side rails and cross rails and cooperate with corners of the top panels to retain the top panels immovable on the frame.

In another aspect of the invention, a third top panel may be positioned on the frame between the first two panels. Clips may then be provided to engage opposed edges of the third top panel and an edge of each opposed cross brace. The clips have a generally C-shaped portion for engaging the panel edge. Extending from an end of the C-shaped portion is a straight leg portion which abuts an inner face of the cross rail thereby preventing relative movement between the third panel and frame. By the foregoing configuration, a knock down bed foundation may be constructed which is conveniently shipped in compact form and which not only has an aesthetically pleasing appearance but is highly sturdy when assembled.

BRIEF DESCRIPTION OF THE DRAWINGS

The foregoing and other novel features of the invention will be better understood upon a reading of the following detailed description taken in conjunction with the accompanying drawings wherein.

DETAILED DESCRIPTION OF THE PREFERRED EMBODIMENT

Figure 1:
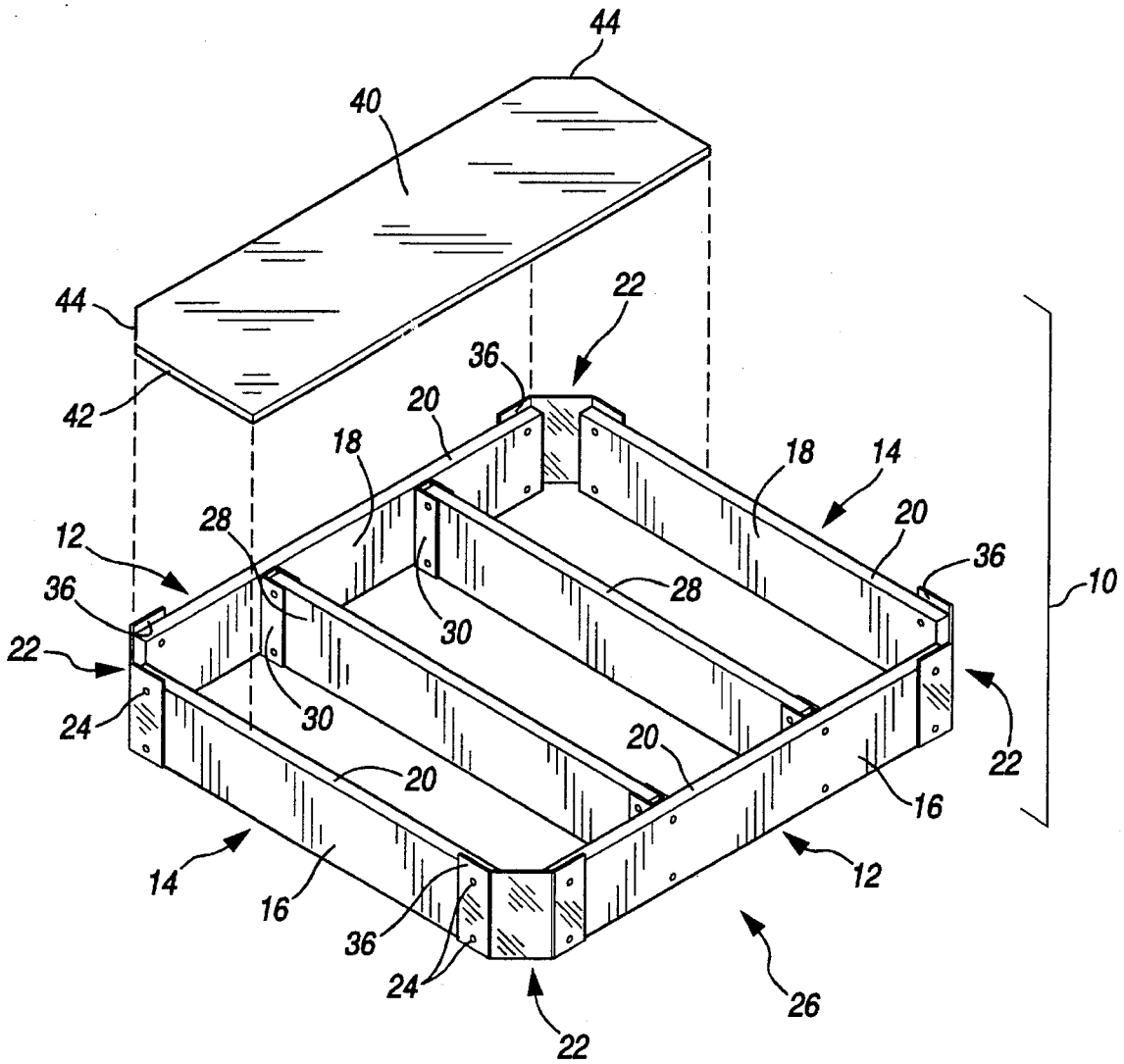
FIG. 1 is an exploded perspective view of a bed foundation constructed in accordance with the invention and shown with two top panels removed.

Referring now to the drawings, and initially to FIG. 1, a bed foundation in accordance with the invention is designated generally by the reference numeral 10 and includes a pair of generally elongate, parallel, spaced side rails 12 and a pair of generally elongate, parallel, spaced cross rails 14. The side rails 12 and cross rails 14 may be constructed from any suitable material such as wood, particle board or a thermoplastic compound. However, preferably, outwardly facing surfaces 16 of the rails 12 and 14 have a finished appearance as provided, for example, by a wood, plastic laminate or paper laminate. Inwardly facing surfaces 18 of the rails 12 and 14 may be unfinished for cost savings. The rails 12 and 14 have a preselected thickness defining upwardly facing edges 20.

Figure 2:
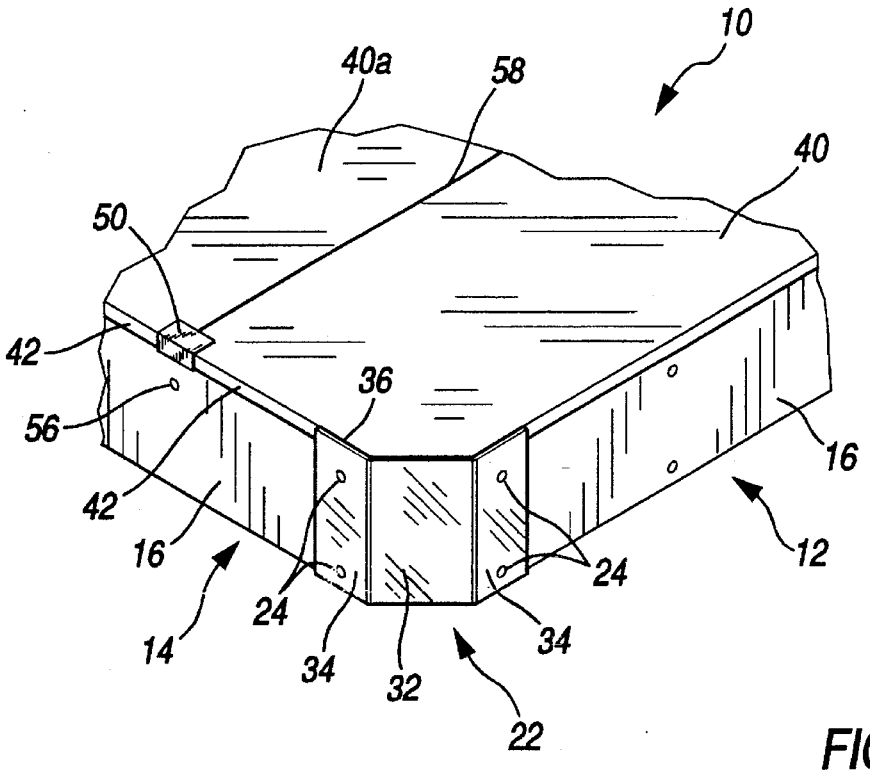
FIG. 2 is a fragmentary perspective view of a corner of the bed foundation shown in FIG. 1 with the top panels installed.

Referring now to FIGS. 1 and 2, the side rails 12 can be seen as connected at their opposed ends to the ends of the cross rails 14 by corner braces 22. Suitable machine screws or bolts 24 may be used to fasten the corner braces 22 to the ends of the rails 12 and 14. The resulting assembly is essentially a rectangular box frame 26 in which the corners form right angles. Interposed between the side rails 12 at points intermediate the ends thereof are a pair of joists 28 connected to the side rails 12 by suitable metal hangers 30. The corner braces 22 each comprise a central web portion 32 having flange portions 34 extending from opposed sides thereof. The flange portions 34 form an angle of 45 degrees with the web portion 32 and thereby extend away from each other defining a 90 degree included angle.

In accordance with the invention, the corner braces 22 are so dimensioned as to extend slightly above the upwardly facing edges 20 of the rails 12 and 14, thereby defining a lip 36 at each corner of the frame 26. The entire frame 26 is covered by a plurality of top panels 40, only one of which is shown in FIG. 1. The top panels 40 are constructed of plywood, particle board or thermoplastic and have a suitable thickness such that they can support the weight of a water mattress or the like, when placed upon the frame 26. For a queen size or king size bed, for example, preferably three top panels 40 are used to cover the frame 26 and, thus, the panels 40 are of such a size as can lend them conveniently to be packaged and shipped. The panels 40 collectively form a platform over the frame 26 which is coextensive with the outer periphery of the frame 26. Therefore, outer edges 42 of the panels 40 are flush with the outwardly facing surfaces 16 of the rails 12 and 14. Corners 44 of the outermost panels 40 are cut on a 45 degree angle. By this configuration, it can be seen that the outermost panels 40 are supported on the frame 26 with the corners 44 in abutment with the lips 36 of the corner braces 22 and are thereby retained immovable with respect to the frame 26 when placed thereon. Preferably, the height of the lip 36 is approximately equal to and no greater than the thickness of the panels 40. Therefore, possible tearing of a mattress placed on the foundation 10 is avoided.

Figure 3:
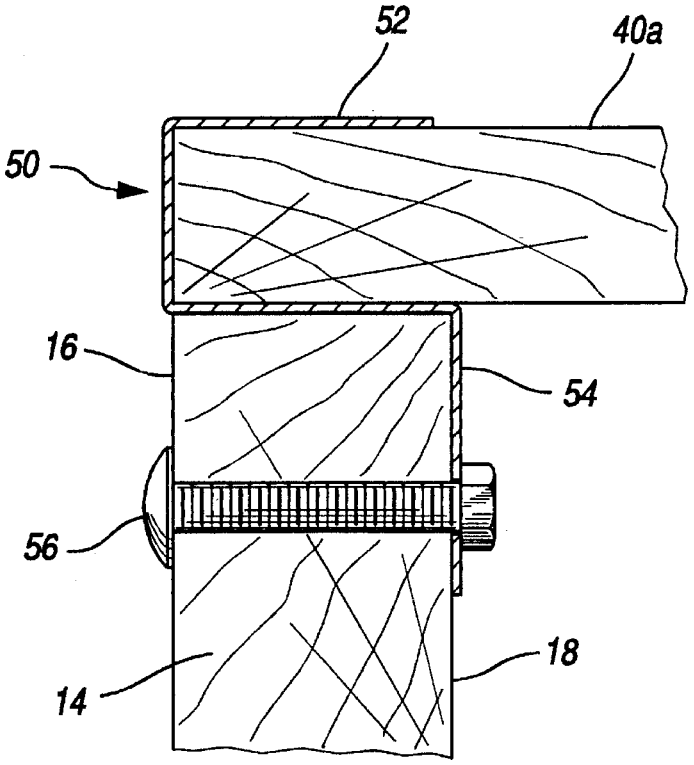
FIG. 3 is a cross-sectional view on an enlarged scale of a top panel retaining clip in accordance with the invention.

FIG. 2 illustrates a corner portion of a bed foundation 10 having and outermost panel 40 installed on the frame 26 next to an interior panel 40*a*. This construction would be appropriate for relatively large beds in order to keep the size of the panels 40 and 40*a* sufficiently manageable to be readily packaged and shipped. The foundation 10 of this construction, therefore, may have three or four panels, with two outermost panels 40 placed on either side of one or inner panels 40*a*. With this construction, it can be appreciated that the inner panel 40*a* does not have its corners in abutment with the corner braces 22 of the frame 26 and, therefore, this panel 40*a* can shift relative to frame 26. Thus, in accordance with the invention, and as best seen in FIGS. 2 and 3, a clip 50 is provided to retain the inner panel 40*a* immovable on the frame 26.

The clip 50 is provided with a generally C-shaped portion 52 having a straight leg portion 54 extending from an end thereof. The C-shaped portion 52 is preferably dimensioned such that it can fictionally engage an outer edge 42 of the panels 40 and 40*a*. The C-shaped portion 52 is further configured such that when it is installed on the edge 42 of a panel 40 and 40*a*, the straight leg portion 54 will abut the inwardly facing surface 18 of the associated cross rail 14. By this construction, the panel 40*a* is retained immovable on the frame 26. The panel 40*a* cannot shift lengthwise on the frame 26 when a clip 50 is installed on both of its ends. Moreover, the two abutting outer most panels 40 retain the inner panel 40*a* against lateral movement. A suitable machine screw or bolt 56 may be used to secure the clip 50 to the rail 14. However, in a preferred embodiment, the machine screw or bolt 56 may be eliminated by constructing the clip 50 of suitable spring steel and overbending the straight leg portion 54 relative to the C-shaped portion 52 such that the straight leg portion 54 frictionally engages the side inner side 18 of the rail 14. As seen in FIG. 2, it is preferred that the clip 50 be positioned at the joint 58 formed between the inner panel 40*a* and the abutting panel 40. By this arrangement, the clip 50 aids in aligning the edges 42 of the panels 40*a* and 40 and helps to maintain the squareness of the frame 26.

It can now be appreciated that the bed foundation 10 of the invention provides a highly sturdy structure for supporting the heaviest of mattresses. Moreover, when disassembled, it can be packaged and conveniently shipped to the consumer. It is also simple in construction owing in part to the novel corner braces 22 which serve the dual purpose of connecting the rails 12 and 14 and also maintaining the top panels 40 secure on the frame 26.

While the present invention has been described in connection with the preferred embodiment thereof, it will be understood by those skilled in the art that many changes and modifications may be made without departing from the true spirit and scope of the invention. Accordingly, it is intended by the appended claims to cover all such changes and modifications as come within the true spirit and scope of the invention.

What is claimed is:

1. A bed foundation comprising:

a pair of parallel, spaced side rails each having opposed ends;

a pair of parallel, spaced cross rails each having opposed ends and extending between said side rails;

a corner brace connecting each end of a side rail to an end of a cross rail at a right angle thereby defining a box frame with edges of said side rails and cross rails facing upwardly and lying in a plane;

at least one joist extending between said rails at points intermediate the ends thereof and having an upwardly facing edge which is coplanar with the edges of the side rails and cross rails; and first and second generally planar top panels, each panel dimensioned and configured to be positioned on and supported by the upwardly facing edges of a side rail, the cross rails and said joist, said top panels each having a peripheral edge of preselected thickness;

wherein said corner braces extend above the plane defined by the upwardly facing edges of the side rails and cross rails and cooperate with corners of said top panels to retain said top panels immovable on said frame.

2. The bed foundation of claim 1 wherein said corner braces extend above the plane defined by the upwardly facing edges of the side rails and cross rails by a height approximately equal to the thickness of said panels.

3. The bed foundation of claim 1 including a third panel positioned intermediate said first and second top panels, said top panels all cooperating to form a platform which is coextensive with the periphery of said frame.

4. The bed foundation of claim 3 including a clip configured to engage both an edge of said third top panel and an edge of a cross rail to retain said third panel immovable with respect to said frame.

5. The bed foundation of claim 4 wherein said clip has a generally C-shaped portion for engaging an edge of said third panel.

6. The bed foundation of claim 5 wherein said clip has a straight leg portion extending from an end of said C-shaped portion and said leg portion cooperates with an inside face of said cross rail to retain said third panel immovable with respect to said frame.

7. The bed foundation of claim 3 including a pair of clips engageable with opposed edges of said third top panel and opposed cross rails to retain said third panel immovable relative to said frame.

8. A bed foundation comprising:

a pair of parallel, spaced side rails each having opposed ends;

a pair of parallel, spaced cross rails each having opposed ends;

the ends of each cross rail each being connected at right angles to an end of a side rail thereby defining a box frame with edges of said side rails and cross rails facing upwardly and lying in a plane, each side rail and cross rail having a surface facing inwardly of said frame and a surface facing outwardly of said frame;

a generally planar top panel dimensioned and configured to be positioned on and supported by the upwardly facing edges of said cross rails, said top panel having peripheral edges lying approximately flush with the outwardly facing surfaces of said cross rails; and a clip having a generally C-shaped portion engaging a peripheral edge of said panel and a straight leg portion extending from an end of said C-shaped portion engaging said inwardly facing surface of said cross rail thereby preventing relative movement between said top panel and said frame.

9. The bed foundation of claim 8 comprising a pair of said clips each disposed on opposite ends of said panel.

10. The bed foundation of claim 1 wherein said corner brace comprises a central web portion and a pair of flange portions extending from opposite sides of said web portion at an angle of 45 degrees therefrom defining a 90 degree included angle.

* * * * *